United States Patent [19]

Rubik

[11] 4,392,323

[45] Jul. 12, 1983

[54] TOY WITH TURNABLE ELEMENTS FOR FORMING GEOMETRIC SHAPES

[75] Inventor: Ernö Rubik, Budapest, Hungary

[73] Assignee: Politoys Ipari Szövetkezet, Budapest, Hungary

[21] Appl. No.: 286,458

[22] Filed: Jul. 24, 1981

[30] Foreign Application Priority Data

Nov. 18, 1980 [HU] Hungary ..... 2752/80

[51] Int. Cl.[3] ..... A63H 33/00

[52] U.S. Cl. ..... 46/1 R; 403/96; 273/153 S

[58] Field of Search ..... 46/1 R, 16, 22, 23, 46/26, 29, 173; 403/93, 94, 96, 97, 101; 273/157, 153 S, 155; 434/160, 277, 278, 279

[56] References Cited

U.S. PATENT DOCUMENTS

| | | | |
|---|---|---|---|
| 604,708 | 5/1898 | Burton | 46/26 |
| 2,877,506 | 3/1959 | Almoslino | 46/26 X |
| 3,222,072 | 12/1965 | Dreyer | 273/157 |
| 3,367,063 | 2/1968 | Bondesen et al. | 46/26 |
| 3,514,893 | 6/1970 | Paksy | 46/1 |
| 3,576,087 | 4/1971 | Gardel et al. | 46/161 |
| 3,597,872 | 8/1971 | Vennola | 46/1 R |
| 3,757,458 | 9/1973 | Thorn | 46/173 X |
| 4,026,065 | 5/1977 | Dick | 46/26 X |
| 4,030,209 | 6/1977 | Dreiding | 46/29 |

FOREIGN PATENT DOCUMENTS

| | | | |
|---|---|---|---|
| 96335 | 6/1963 | Denmark . | |
| 7005541 | 2/1970 | Fed. Rep. of Germany . | |
| 598185 | 9/1925 | France | 46/22 |
| 923907 | 4/1963 | United Kingdom . | |
| 1224852 | 3/1971 | United Kingdom . | |
| 1376301 | 12/1974 | United Kingdom . | |
| 1585436 | 3/1981 | United Kingdom . | |

*Primary Examiner*—F. Barry Shay

*Attorney, Agent, or Firm*—Gabriel P. Katona

[57] ABSTRACT

A toy for constructing different geometric shapes has a plurality of hollow prismatic identical toy elements having a triangular base and quadratic faces. The elements are connected at two faces to adjoining elements by spring biased headed pins passing through aligned throughbores in the centers of the two faces to permit relative rotation about axis normal to the two faces. The elements are maintained in any one of a plurality of angular orientations by projections on one of the two faces of each element and depressions in the other face of each toy element.

4 Claims, 4 Drawing Figures

TOY WITH TURNABLE ELEMENTS FOR FORMING GEOMETRIC SHAPES

BACKGROUND OF THE INVENTION

The invention relates to a toy for constructing different geometric forms, assembled with identical adjoining interconnected prismatic elements in such a manner, that the single elements can be rotated along their contact surfaces and by performing the rotating movement numerous geometric solids can be formed. In an assembled state the toy forms a quadratic prism with bevelled ends.

Toys for constructing different geometric forms have been well known for a long time. These toys consist of diverse solids being identical within one group and being well suited for the construction of diverse spatial formations. Preferably they are made of wood or ceramics, they are colored and are mostly available in boxes. The drawback of these toys lies in the fact that the single toy elements get lost, the missing pieces cannot be replaced and since the complete toy is built up of these pieces, due to the lost elements the number of possible solids becomes significantly lessened.

Accordingly, development has been tending to the construction of a building toy consisting of interconnected elements. As a result, a toy has been developed, in which extended octagonal toy elements are interconnected in a chainlike manner. The disadvantageous feature of this toy lies in the fact that the elements can be displaced in only one single plane in relation to each other, accordingly, the number of variations is restricted to plane formations.

Spatial logical toys consisting of toy elements built together are also well known. These are constructed in such a manner, that the toy elements being connected by means of solids should form a regular or irregular (amorphous) solid, a body, while the toy elements can be rotated along the spatial axes of the constructed body. The outer surfaces of the toy elements are either colored or carry figures, numbers or other symbols and by rotating the single toy elements a lot of variations become possible.

SUMMARY OF THE INVENTION

The object of the present invention is to provide a toy which avoids the disadvantages of the prior art and differs from all other well known toys, in that by turning the elements forming the toy, the solid showing the form of a quadratic prism in its basic position may assume many different shapes.

Accordingly, another object of the invention is to construct a toy consisting of interconnected elements being well suitable for producing different formations, which can be rotated along their contact surfaces by means of the flexible connecting elements arranged in between, resulting in different geometric solids.

The objects are achieved by a toy built-up of interconnected geometric solids, which form a quadratic prismatic elements in the assembled state, the two ends of the prism being bevelled and by turning the elements many diverse shapes may be obtained in dependence of the number of the elements utilized.

BRIEF DESCRIPTION OF THE DRAWINGS

The invention will be described in details by means of the accompanying drawings, wherein.

DETAILED DESCRIPTION OF THE PREFERRED EMBODIMENTS

Figure 1:
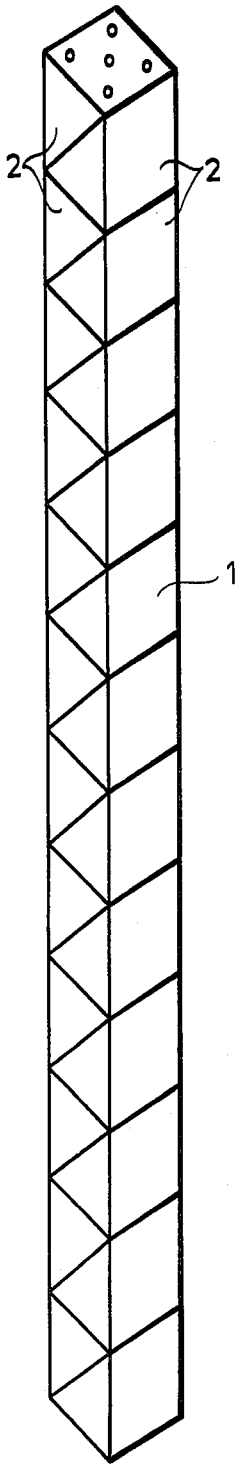
FIG. 1 is a plan view of the toy in the initial assembled state.
Figure 2:
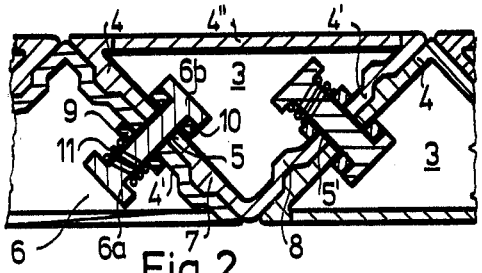
FIG. 2 is a partial longitudinal section of the toy of FIG. 1.
Figure 3:
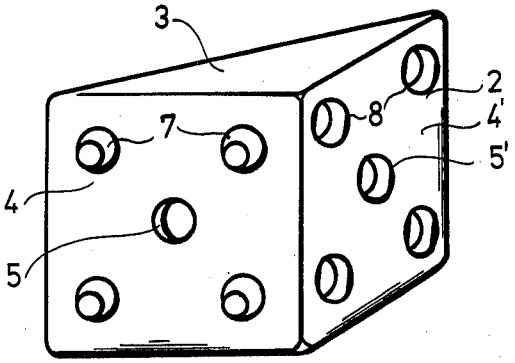
FIG. 3 is a plan view of one of the homologeous elements forming the toy of FIG. 1.

Referring now to FIGS. 1–3, the toy 1 comprises hollow prismatic elements 2, each having a triangular base 3 lateral faces formed by congruent squares or quadratic side faces 4,4' and a rectangular or quadratic hypotenuse outer surface 4''. The triangles 3 forming the base and the cover are not necessarily right-angle triangles, they may be triangles with 60° apex angles. For the purpose of expedience and for practicality, the number of the elements has been chosen as twelve or twenty-four.

The single elements 2 are interconnected at the quadratic lateral faces 4,4' of the elements by means of pins 6 through bores 5,5' therein. The elements 2 are joined in such a manner that every single element is touching the confining two elements along their quadratic confining face 4,4'.

FIG. 2 is showing the mode of interconnection between the single elements 2. On the mutually contacting surfaces 4,4' of the hollow elements there are the aligned throughbores 5,5'. The mutually contacting elements are interconnected by means of the pins 6 each enclosed by a spring 11 and each formed with widened diameter heads **6*a*, 6*b* at each end. The pins 6 are inserted in the aligned throughbores 5,5' with nylon washers 9 and 10 bearing on the inner surfaces of the sides 4,4' and by means of the spring-actuated pin assembly, the single elements 2** are kept within a mutual distance determined by the elasticity limit of the springs.

In order to ensure the fixed position of the contacting element surfaces 4,4', the surfaces 4,4' are formed in such a manner, that on one of the matching faces 4, frustoconical projections 7 are formed having a height of several tenths of a millimeter, whereas on the other contacting faces 4', the depressions 8 of the same position and size are formed.

If one wishes to turn any of the elements 2, the matching faces 4,4', being inclined, slide on each other against the spring force.

As already mentioned before, the number of the elements expediently amounts to twelve or twenty-four, since it was found that by rotating the elements, with so many units the most diverse formations may be obtained in a most advantageous way.

Figure 4:
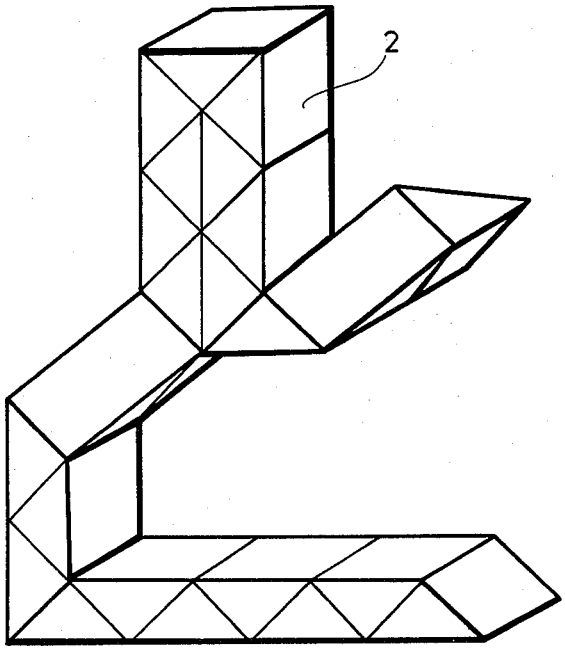
FIG. 4 is a plan view of a embodiment of the toy forming a geometric solid to serve as an example.

An embodiment serving as an example for the solid obtained by rotation is to be seen in FIG. 4. The toy having been constructed in the sense of the invention can be excellently used as a device for teaching solid geometry. The toy may be produced of a synthetic material in different colors by injection molding, thus promoting demonstrative teaching.

What is claimed is:

1. A toy for constructing different geometric shapes comprising: a plurality of identical toy elements each comprising an isoceles right triangular prism having two square side faces and a quadratic hypotenuse face; means connecting the elements in a row with side faces of each intermediate identical element abutting side faces of other identical elements for rotation of each element about the axis normal to each abutting side face and relative to the remaining elements; and means for positively maintaining each element in any one of four equally spaced discrete angular orientations relative to the adjacent elements.

2. The toy according to claim 1, wherein the means connecting the elements in a row connects same at solely the two square side faces of each intermediate prism to permit rotation of each element about the axis normal to either of said two side faces and relative to the remaining elements without permitting separation in response to a force along said axis, the connecting means comprising a throughbore in the center of each of the two side faces, a connecting element disposed through the aligned throughbores of each pair of abutting side faces and means urging each pair of abutting square side faces toward each other, and the means for positively maintaining each toy element in any one of four angular orientations relative to the adjacent toy elements comprises four projections on one of the two square side faces of each toy element and four depressions on the other of the two square side faces of each element, the projections being configured to be received in the depressions in any one of the four angular orientations.

3. The toy according to claim 2, wherein the connecting element is a headed pin and the urging means comprises a spring.

4. The toy according to claim 1, wherein the means connecting the toy elements in a row connects same at solely the two square side faces of each intermediate prism to permit rotation of each element about the axes normal to either of said two side faces and relative to the remaining toy elements and urges each pair of abutting side faces toward each other, the connecting means comprising a throughbore in the center of each of the two side faces, a connecting element disposed through the aligned throughbores of each pair of abutting side faces, and the means for positively maintaining each toy element in any one of four angular orientations relative to the adjacent toy elements comprises four projections on one of the two quadratic side faces of each toy element and four depressions on the other of the two quadratic side faces of each toy element, the projections being configured to be received in the depressions in any one of the four angular orientations.

* * * * *